US010483609B2

(12) United States Patent
Payne et al.

(10) Patent No.: US 10,483,609 B2
(45) Date of Patent: *Nov. 19, 2019

(54) DIELECTRIC WAVEGUIDE HAVING A CORE AND CLADDING FORMED IN A FLEXIBLE MULTI-LAYER SUBSTRATE

(71) Applicant: TEXAS INSTRUMENTS INCORPORATED, Dallas, TX (US)

(72) Inventors: Robert Floyd Payne, Lucas, TX (US); Gerd Schuppener, Allen, TX (US); Juan Alejandro Herbsommer, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/614,969

(22) Filed: Jun. 6, 2017

(65) Prior Publication Data

US 2017/0271736 A1 Sep. 21, 2017

Related U.S. Application Data

(63) Continuation of application No. 14/555,545, filed on Nov. 26, 2014, now Pat. No. 9,705,174.

(60) Provisional application No. 61/977,400, filed on Apr. 9, 2014.

(51) Int. Cl.
*H01P 3/16* (2006.01)
*H01P 11/00* (2006.01)

(52) U.S. Cl.
CPC ..... *H01P 3/16* (2013.01); *H01P 11/006* (2013.01)

(58) Field of Classification Search
CPC .... H01P 3/16; H01P 3/165; H01P 3/18; H01P 11/006
USPC ..... 333/239, 241
See application file for complete search history.

(56) References Cited

U.S. PATENT DOCUMENTS

| | | | | |
|---|---|---|---|---|
| 5,889,449 | A | 3/1999 | Fiedziuszko | |
| 6,104,264 | A | 8/2000 | Ishikawa et al. | |
| 6,909,345 | B1 | 6/2005 | Salmela et al. | |
| 7,515,366 | B2 | 4/2009 | Chang | |
| 7,557,758 | B2 | 7/2009 | Rofougaran | |
| 9,705,174 | B2 * | 7/2017 | Payne et al. | H01P 3/16 |
| 2012/0326813 | A1 | 12/2012 | Wong et al. | |

(Continued)

OTHER PUBLICATIONS

3D Printing, Wikipedia, pp. 1-35, available at http://en.wikipedia.org/w/index.php?title=3D_printing&oldid=624190184 on Sep. 4, 2014.

(Continued)

*Primary Examiner* — Benny T Lee
(74) *Attorney, Agent, or Firm* — Ronald O. Neerings; Charles A. Brill; Frank D. Cimino

(57) ABSTRACT

A digital system has a dielectric core waveguide that is formed within a multilayer substrate. The dielectric waveguide has a longitudinal dielectric core member formed in the core layer having two adjacent longitudinal sides each separated from the core layer by a corresponding slot portion formed in the core layer The dielectric core member has the first dielectric constant value. A cladding surrounds the dielectric core member formed by a top layer and the bottom layer infilling the slot portions of the core layer. The cladding has a dielectric constant value that is lower than the first dielectric constant value.

17 Claims, 6 Drawing Sheets

(56) References Cited

U.S. PATENT DOCUMENTS

2013/0104387 A1 5/2013 Ma et al.

OTHER PUBLICATIONS

C. Yeh et al, Dielectric Ribbon Waveguide: An Optimum Configuration for Ultra-Low-Loss Millimeter/Submillimeter Dielectric Waveguide:, IEEE Transactions on Microwave Theory and Techniques, vol. 3.8, No. 6, Jun. 1990, pp. 691-702.

* cited by examiner

DIELECTRIC WAVEGUIDE HAVING A CORE AND CLADDING FORMED IN A FLEXIBLE MULTI-LAYER SUBSTRATE

CROSS-REFERENCE TO RELATED APPLICATIONS

This application is a continuation of U.S. patent application Ser. No. 14/555,545 filed Nov. 26, 2014, now U.S. Pat. No. 9,705,174, which claims priority to U.S. Provisional Application No. 61/977,400 filed Apr. 9, 2014, both of which are hereby fully incorporated herein by reference for all purposes.

FIELD OF THE INVENTION

This invention generally relates to wave guides for high frequency signals, and in particular to waveguides with dielectric cores.

BACKGROUND OF THE INVENTION

In electromagnetic and communications engineering, the term "waveguide" may refer to any linear structure that conveys electromagnetic waves between endpoints thereof. The original and most common meaning is a hollow metal pipe used to carry radio waves. This type of waveguide is used as a transmission line for such purposes as connecting microwave transmitters and receivers to respective antennas, in equipment such as microwave ovens, radar sets, satellite communications, and microwave radio links.

A dielectric is an electrical insulator that can be polarized by an applied electric field. When a dielectric is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field which reduces the overall field within the dielectric itself. If a dielectric is composed of weakly bonded molecules, those molecules not only become polarized, but also reorient so that their symmetry axis aligns to the field. While the term "insulator" implies low electrical conduction, "dielectric" is typically used to describe materials with a high polarizability; which is expressed by a number called the "relative permittivity (εk)". The term "insulator" is generally used to indicate electrical obstruction while the term "dielectric" is used to indicate the energy storing capacity of the material by means of polarization.

Permittivity is a material property that expresses a measure of the energy storage per unit meter of a material due to electric polarization $(J/V^2)/(m)$. Relative permittivity is the factor by which the electric field between the charges is decreased or increased relative to vacuum. Permittivity is typically represented by the Greek letter e. Relative permittivity is also commonly known as dielectric constant.

Permeability is the measure of the ability of a material to support the formation of a magnetic field within the material in response to an applied magnetic field. Magnetic permeability is typically represented by the Greek letter μ.

The electromagnetic waves in a metal-pipe waveguide may be imagined as travelling down the guide in a zig-zag path, being repeatedly reflected between opposite walls of the guide. For the particular case of a rectangular waveguide, it is possible to base an exact analysis on this view. Propagation in a dielectric waveguide may be viewed in the same way, with the waves confined to the dielectric by total internal reflection at the surface thereof.

BRIEF DESCRIPTION OF THE DRAWINGS

Particular embodiments in accordance with the invention will now be described, by way of example only, and with reference to the accompanying drawings.

Figure 1:
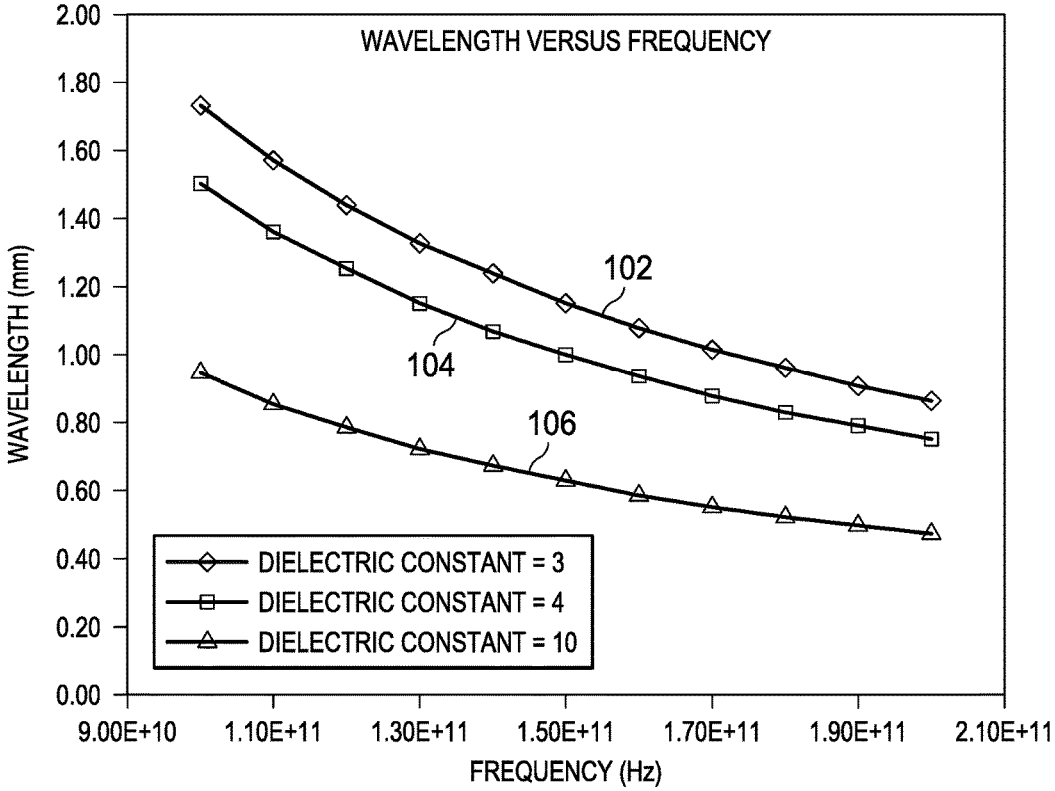
FIG. 1 is a plot of wavelength versus frequency through materials of various dielectric constants.

Other features of the present embodiments will be apparent from the accompanying drawings and from the detailed description that follows.

DETAILED DESCRIPTION OF EMBODIMENTS OF THE INVENTION

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Dielectric waveguides (DWG) are now used in various ways for communication between different nodes in a system. Embodiments of the present invention may use a low-cost flexible printed circuit board (PCB) substrate material such as DuPont's KAPTON™ (polyimide) as the transmission media of a DWG.

As frequencies in electronic components and systems increase, the wavelength decreases in a corresponding manner. For example, many computer processors now operate in the gigahertz realm. As operating frequencies increase to the sub-terahertz (THz) realm, the wavelengths become short enough that signal lines that exceed a short distance may act as an antenna and signal radiation may occur. FIG. 1 is a plot of wavelength in mm versus frequency in Hz through materials of various dielectric constants. As illustrated by plot 102 which represents a material with a low dielectric constant of 3, such as a printed circuit board, a 100 GHz signal will have a wavelength λ of approximately 1.7 mm. Thus, a signal line that is only 1.7 mm in length may act as a full wave antenna and radiate a significant percentage of the signal energy. In fact, even lines of λ/10 are good radiators, therefore a line as short as 170 um may act as a good antenna at this frequency. Plot 104 represents a material with a dielectric constant of 4. Plot 146 represents a material with a dielectric constant of 10.

Waves in open space propagate in all directions, as spherical waves. In this way they lose their power proportionally to the square of the distance; that is, at a distance R from the source, the power is the source power divided by R squared. A wave guide may be used to transport high frequency signals over relatively long distances. The waveguide confines the wave to propagation in one dimension, so that under ideal conditions the wave loses no power while propagating. Electromagnetic wave propagation along the axis of the waveguide is described by the wave equation, which is derived from Maxwell's equations, and where the wavelength depends upon the structure of the waveguide, and the material therewithin (air, plastic, vacuum, etc.), as well as on the frequency of the wave. Commonly-used waveguides are only of a few categories. The most common kind of waveguide is one that has a rectangular cross-section, one that is usually not square. It is common for the long side of this cross-section to be twice as long as its short side. These are useful for carrying electromagnetic waves that are horizontally or vertically polarized.

For the exceedingly small wavelengths encountered for sub-THz radio frequency (RF) signals, dielectric waveguides perform well and are much less expensive to fabricate than hollow metal waveguides. Furthermore, a metallic waveguide has a frequency cutoff determined by the size of the waveguide. Below the cutoff frequency there is no propagation of the electromagnetic field. Dielectric waveguides may have a wider range of operation without a fixed cutoff point. However, a purely dielectric waveguide may be subject to interference caused by touching by fingers or hands, or by other conductive objects. Metallic waveguides confine all fields and therefore do not suffer from EMI (electromagnetic interference) and cross-talk issues; therefore, a dielectric waveguide with a metallic cladding may provide significant isolation from external sources of interference. Various types of dielectric core waveguides will be described in more detail below.

Figure 2:
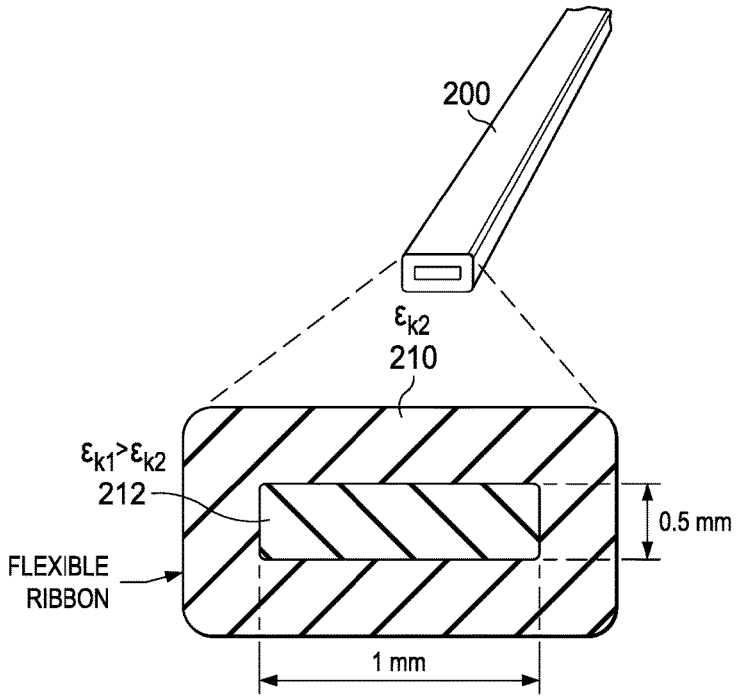
FIG. 2 (PRIOR ART)
FIG. 2 is an illustration of an example prior art dielectric waveguide.

FIG. 2 illustrates a prior art DWG 200 that is configured as a thin flexible ribbon of a core dielectric material surrounding by a dielectric cladding material. The core dielectric material has a dielectric constant value $\varepsilon\mathbf{1}$, while the cladding has a dielectric constant value of $\varepsilon\mathbf{2}$, where $\varepsilon\mathbf{1}$ is greater than $\varepsilon\mathbf{2}$. In this example, a thin rectangular ribbon of the core material 212 is surrounded by the cladding material 210. For sub-terahertz signals, such as in the range of 130-150 gigahertz, a core dimension of approximately 0.5 mm×1.0 mm works well. DWG 200 may be fabricated using known extrusion techniques, for example.

Various configurations of dielectric waveguides (DWG) and interconnect schemes are described in U.S. patent application Ser. No. 13/854,935 filed Apr. 1, 2013, now U.S. Pat. No. 9,515,366), entitled "Dielectric Waveguide Manufactured Using Printed Circuit Board Technology" and are incorporated by reference herein. Various antenna configurations for launching and receiving radio frequency signals to/from a DWG are also described therein and are incorporated by reference herein.

Example use cases for the DWG concept described in U.S. patent application Ser. No. 13/854,935, now U.S. Pat. No. 9,515,366), include a silicon die packaged in a flip chip ball grid array (BGA) where the launch structures (antenna) from the die into the waveguide are printed on the package substrate. The die may be bumped and mounted to the package substrate and the packaged device mounted to a PCB. Various launch configurations include: end-launch, top-launch, and bottom launch antennae, for example.

In some extremely cost sensitive applications, the cost overhead of a BGA package may not be tolerated. For these applications, a lower cost solution will now be described.

Figure 3:
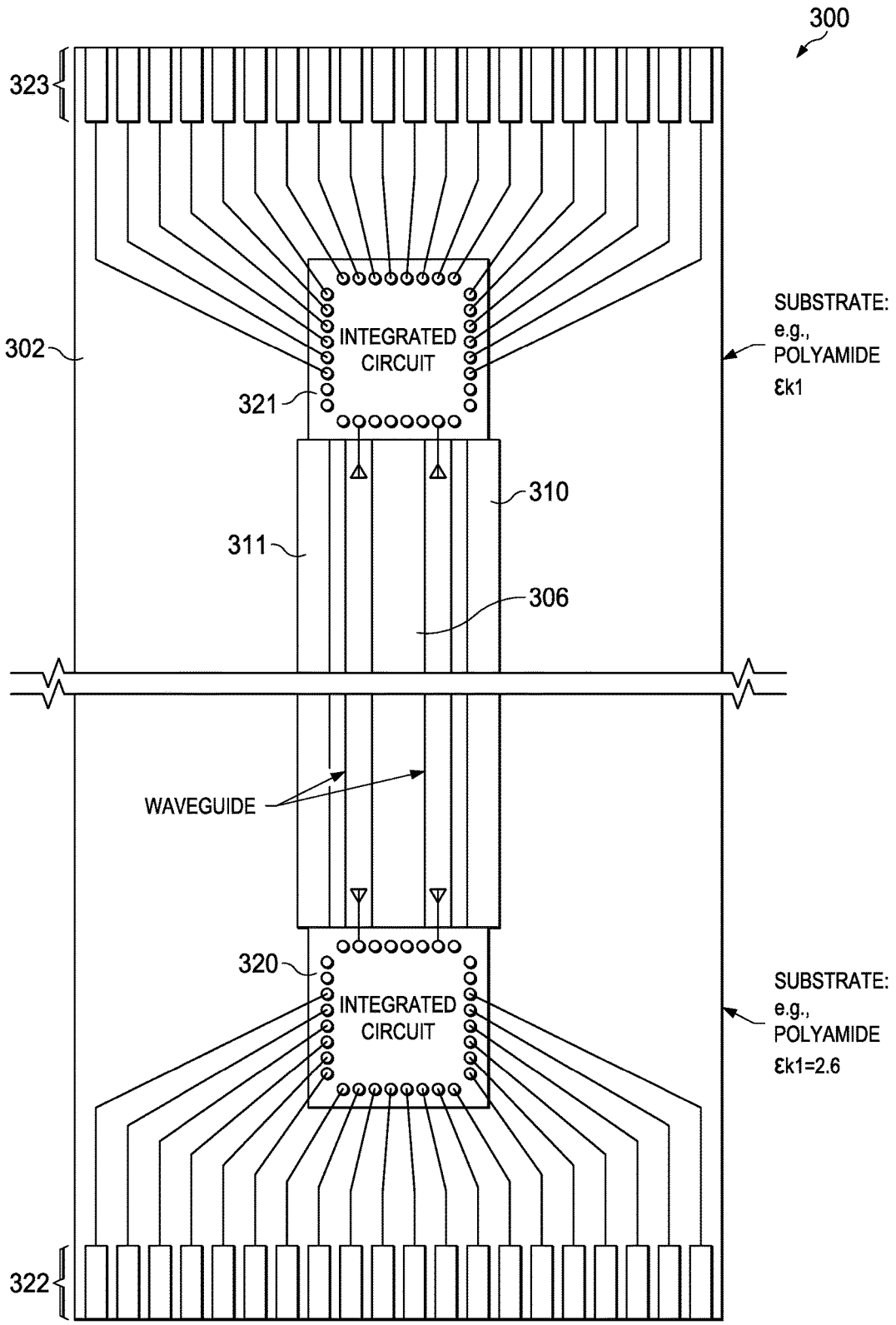
FIG. 3 is an illustration of an example system that includes a dielectric waveguide that uses a portion of a flexible substrate as a core for the dielectric waveguide.

FIG. 3 is an illustration of an example low cost system 300 that includes a dielectric waveguide that uses a portion of a flexible PCB substrate 302 (e.g., polyamide) as a core for the dielectric waveguides 310, 311. In this example, rather than using packaged integrated circuits (IC), bare bumped integrated circuit (IC) die 320, 321 are mounted directly to substrate 302 using known soldering techniques or later developed methods. This is common practice in certain applications where costs must be kept extremely low or in systems where the additional area overhead of the package cannot be tolerated. In other systems, the parasitic impedances resulting from the package may also impede the integrity of signals sent to and received by the IC. By mounting the die directly to the substrate material, these may be avoided. In either case, many of these systems may use a flexible substrate such as KAPTON™ (polyimide) due to its low cost and compatibility with common PCB manufacturing flows. KAPTON™ is a polyimide film developed by DuPont that remains stable across a wide range of temperatures, from −269 to +400° C., for example.

It is possible to build traditional copper interconnect on the flexible substrate 302. In addition, it is also possible to directly print antennae in the flexible substrate 302 to broadcast and receive wirelessly. However, as discussed above in more detail, DWGs may provide a better communication path between bare bump integrated circuit (IC) dies 320, 321 than copper wire or wireless transmissions. Fabricating the dielectric waveguides 310, 311 directly into the flexible PCB substrate 302 may simplify the fabrication process and thereby reduce costs.

In this example, system 300 may be used as an "active cable" where signals, power, and ground are connected to bare bump integrated circuit (IC) dies 320, 321 on each end of the flexible PCB 302, for example. The configuration can be duplicated on each end of the substrate to provide a point-to-point interconnect solution. For this case, two waveguides 310, 311 are illustrated which could be used for example in a bidirectional communications link. In at least one embodiment cladding material 306 is placed between wave guide 310 and waveguide 311.

In this example, system 300 therefore includes connectors 322, 323 that interface with ICs 320, 321 and provide a way to connect to the other systems. For example, multiple streams of data may be received via connector 322 and provided to IC 320, which may then process the data into a single data stream and transmit it to IC 321 via DWG 310. IC 321 may then process the single data stream into multiple data streams and provide the data to another system via connector 323. Similarly, multiple streams of data may be received via connector 323 and provided to IC 321, which may then process the data into a single data stream and transmit it to IC 320 via DWG 311. IC 320 may then process the single data stream into multiple data streams and provide the data to another system via connector 322.

In other embodiments, there may be additional ICs interconnected using DWGs, copper, optic, or other known or later developed interconnect technologies, for example. There may be more or fewer connectors, for example. The presence or absence of connectors such as 322, 323 will be determined by the intended function of the system.

In another example, there may be just a single DWG interconnecting two nodes, for example. Similarly, in another example there may be more than two DWGs interconnecting two nodes or multiple nodes, for example.

Figure 4:
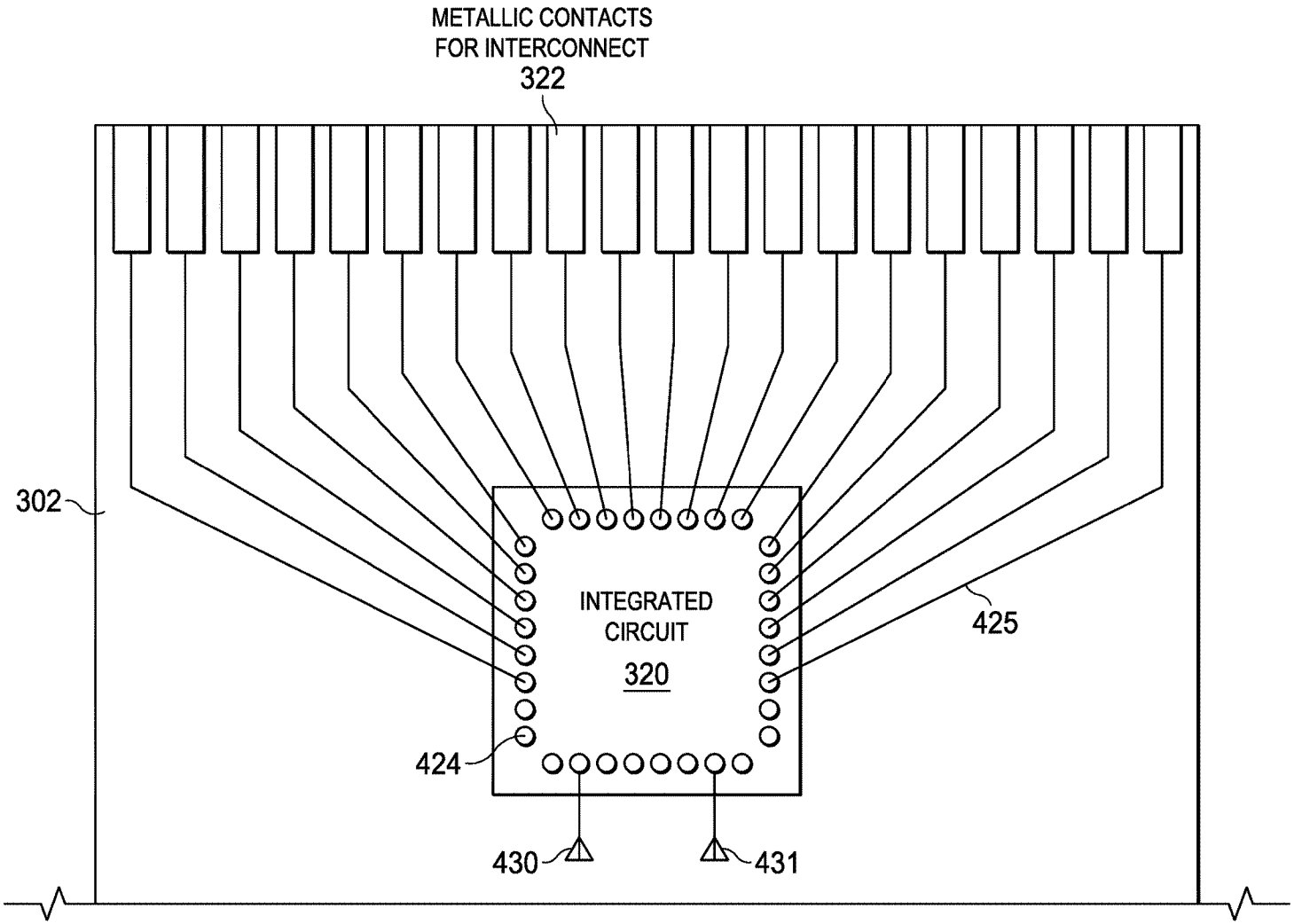
FIG. 4 is a more detailed view of a portion of the system of FIG. 3 illustrating a waveguide antenna that may be printed on the flexible substrate.

FIG. 4 is a more detailed view of a portion of the system of FIG. 3. As mentioned above, in this example bare bumped integrated circuit (IC) die 320 may be soldered directly to landing pads formed on flexible polyamide substrate 302 and thereby make contact with metallic, or other types of conductive leads 425 that then connect to metallic interconnect contacts 322.

Waveguide launching antennas 430, 431 may be printed directly on substrate 302 and connect to bare die 320 by die solder bumps, for example. The conductive leads may be metallic conductors formed by plating and etching for example. Alternatively, they may be formed by other known or later developed technologies, such as: screen printing a conductive paste, printing with a 3D printing technology, etc., for example.

Figure 5A:
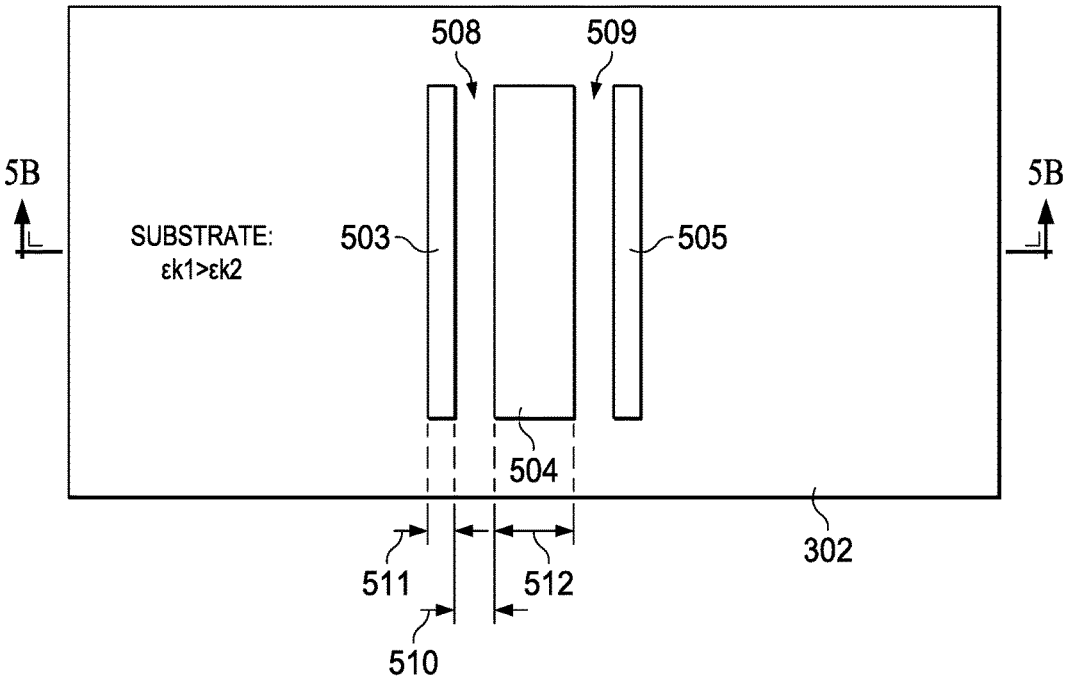
FIGS. 5A, 5B, 5C are more detailed views of another portion of the system of FIG. 3 illustrating fabrication of a dielectric waveguide using a portion of the flexible substrate as the core for the dielectric waveguide.
Figure 5B:
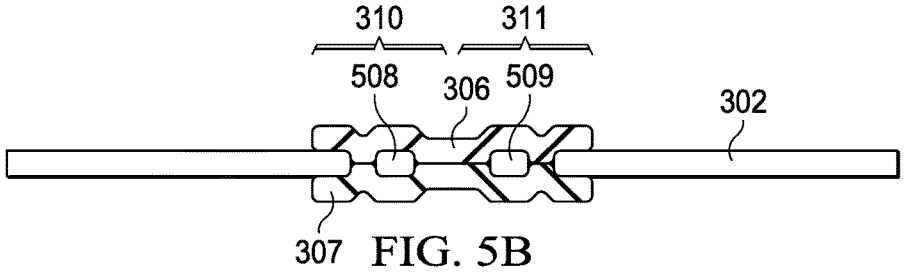
Figure 5C:
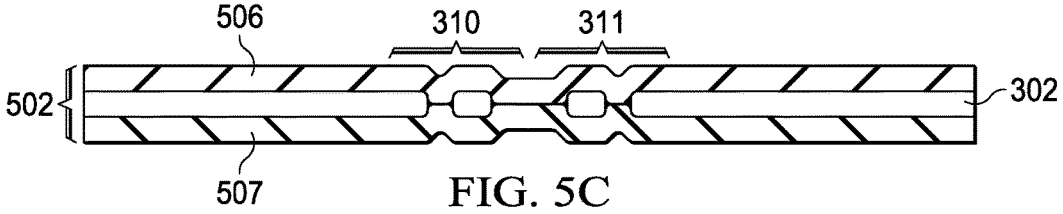

FIG. 5A is a more detailed top view of substrate 302 illustrating fabrication of dielectric waveguides 310, 311, as shown in FIG. 3, using a portion 508, 509 of the flexible substrate as the core for the dielectric waveguide. FIG. 5B is a section view, along line 5B-5B, of substrate 302 after application of cladding material 306, 307 to form DWGs 310, 311. FIG. 5C is a section view of multilayer substrate 502 that includes a substrate 302 between cladding layers 506, 507 to form DWGs 310, 311.

As explained above, the DWG concept requires two dielectric materials that have contrasting dielectric constants, see FIG. 2. The core material, ek1 has a dielectric constant that is greater than a cladding material, ek2. When transmitting a signal inside this waveguide, the electric fields are concentrated in the core material due to the higher ek1. The cladding material enables the electric fields to remain inside the core even as the waveguide itself has twists and bends.

To construct the waveguide, first, slots 503, 504, 505 are cut in the substrate material 302 in order to define the structure and width of the waveguide core 508, 509, as shown in FIG. 5A. The slots may be cut using various known or later developed techniques, such as: stamping, piercing, etching, laser trimming, etc., for example. For this example, the flexible substrate material is used as the waveguide core and thus should be chosen to have a higher dielectric constant than the proposed cladding. There are commercially available materials such as polyimide that may have an ek approximately equal to 3.5, which works well for this application. In other embodiments, flexible substrates may be used that have an ek1 value that is lower, such as the ek1 value of 2.6 shown in FIG. 3, or higher than 3.5, as long as the chosen cladding material has lower ek2 value.

The width 510, in FIG. 5A, of the core region material 508, 509 is chosen to support the proper mode of electromagnetic propagation. The thickness of the substrate for this case is not constrained; literature suggests that thin ribbon-like structures are a good configuration for the DWG, for example, see "Dielectric Ribbon Waveguide: An Optimum Configuration for Ultra-Low-Loss Millimeter/Submillimeter Dielectric Waveguide;" C. Yeh, et al; IEEE TRANSACTIONS ON MICROWAVE THEORY AND TECHNIQUES, VOL3. 8, No. 6, JUNE 1990. Equation (1) is a simplified equation for the wavelength (WL) of signal being transmitted in a dielectric ribbon.

$$WL = \frac{c}{f} * \frac{1}{\sqrt{ek}} \tag{1}$$

where: c is velocity of light in a vacuum, f is a desired operating frequency, ek is the relative permittivity.

For example, if the desired carrier frequency in the waveguide is 140 GHz and ek=3.5, then the wavelength inside the core would be approximately 1.1 mm, as shown in equation (2).

$$WL = \frac{c}{140\ \text{GHz}} * \frac{1}{\sqrt{3.5}} \tag{2}$$

$$WL = 1.1\ \text{mm}$$

A width 510 for the dielectric ribbon core may then be chosen to be similar to this wavelength. The width 511, 512 of the slots 503, 505 will define the thickness of the cladding material in the lateral direction of the waveguide. This would be chosen to meet the isolation requirements of the system. Typically, more cladding in the lateral dimension will result in improved isolation between the two waveguides, such as in this example.

The length of DWG 310, 311 may be arbitrarily long. However, the length of the DWG may be limited by the "attenuation budget" available since the transceiver must allow for a determined attenuation of the signal between signal transmission (TX) and signal reception (RX). The maximum length of the DWG depends on several factors, including: the material of the DWG, its attenuation, isolation properties, bending loss and number of curves, etc., for example.

However, if the length becomes too long the slot width may become unstable. In that case, an occasional nib may be left spanning the slot to stabilize the core portion between the slots, as long as the nib is much smaller than the wavelength of the EM wave travelling through the DWG. Once the cladding layers are applied, the cladding will provide stabilization for the core between the slots.

Once the slots are cut in the substrate material, a cladding material may be laminated onto the flexible substrate. This cladding material may be any of a number of flexible "pre-preg" materials, for example. From an electrical standpoint, it may beneficial for the cladding to have a low loss tangent as well as have a dielectric constant lower than the core material. Loss tangent is a parameter that is used to define losses within a dielectric material. When the conductivity is very low the loss tangent is essentially the ratio between the imaginary and real components of the complex dielectric constant.

As mentioned above, the greater the contrast between the dielectric constant of the core and the cladding will yield better isolation of energy within the waveguide. The lamination may be performed using standard PCB processing techniques where it is common to use heat and/or pressure to bond various PCB materials. The resulting laminate of materials will "fill in" the gap in the slots in between the patterned waveguides. This provides a cladding material completely surrounding the core.

In some embodiments, the cladding material may cover the entire surface of both sides of the substrate. In other embodiments, the cladding material may be shaped to a smaller size either before laminating it to the substrate or afterwards, such as by etching, stamping, laser cutting, etc., for example. In other embodiments, the cladding material may be applied as a paste or other liquid form by using screen printing, 3D printing, etc., for example.

Figure 6A:
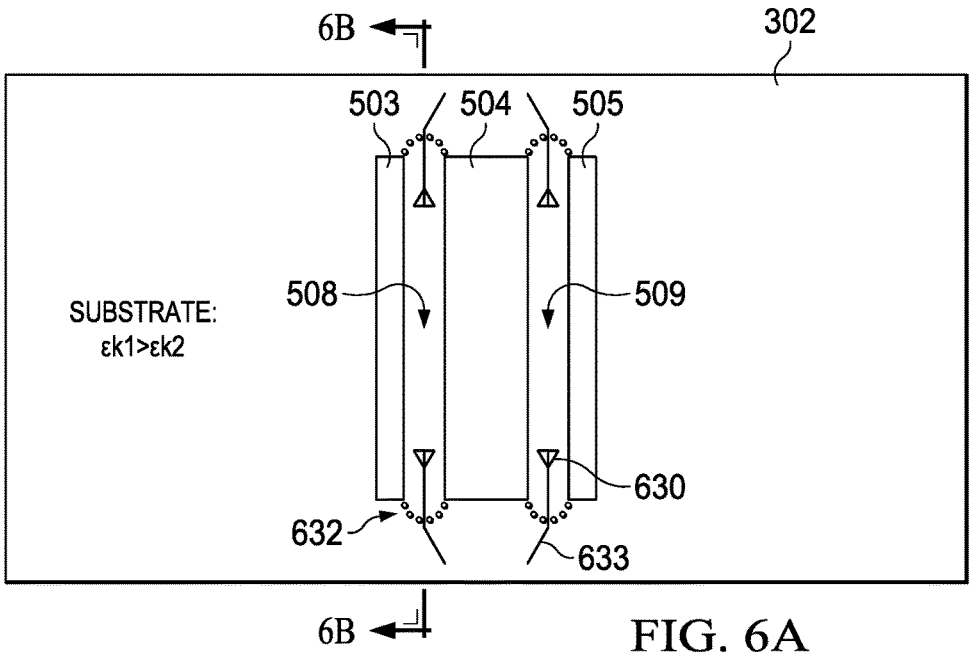
FIGS. 6A and 6B are more detailed view of a portion of the system of FIG. 3 illustrating details of an antenna structure that may be printed on the flexible substrate.
Figure 6B:
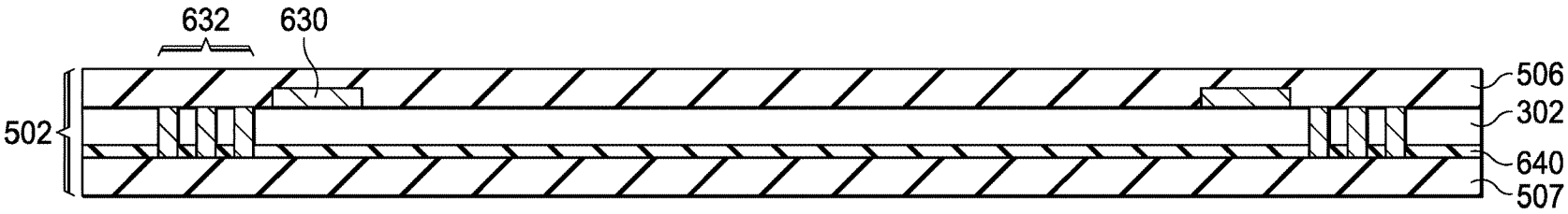

FIG. 6 is a more detailed view of a portion of the system of FIG. 3 illustrating details of an antenna structure 630 that may be printed on the flexible substrate 302. In order to improve the launching of the RF signal into the waveguide, it may be useful to fabricate the antennae with some directivity. A ground reflector built around the antenna may be constructed so as to directionally focus the RF energy into the DWG, avoid crosstalk between different antennae, and to improve the antennae gain.

An array of vias 632 may be patterned and placed around the DWG antennae 630. These vias may be filled or plated with metallic conductors and connected to a suitable ground. These may provide a suitable reflector to improve the directivity. While the reflector is illustrated as one row of vias 632, it may be implemented as more than one row in different embodiments. Traces may also be patterned to interconnect the vias similar to a string of pearls, for example, in order to form a more solid reflecting surface. Transmission line 633 may also be provided to connect antenna 630 to an IC that is mounted on substrate 302 using solder bumps, as described in more detail above, for example.

While a flexible substrate 302 made from a polyimide sheet having an ek1 value of approximately 3.5 was described above, in other embodiments flexible substrates may be used that have an ek1 value that is lower or higher than 3.5, as long as the chosen cladding material has lower ek2 value. In other embodiments, the substrate may be a non-flexible material. The substrate may be any commonly used or later developed material used for electronic systems and packages, such as: silicon, ceramic, Plexiglas, fiberglass, plastic, metal, etc., for example. The substrate may be as simple as paper, for example, as long as the chosen cladding material has lower ek2 value.

The fabrication techniques described above may be performed using standard, low cost, planar PCB processing techniques, for example. This allows low cost systems to make use of DWGs for signal transmission between nodes in the system.

In another embodiment, various signal lines such as transmission lines 425 (FIG. 4), 633 (FIG. 6) may be fabricated using a printing process. Similarly, the cladding material may be applied using a printing process, such as an inkjet printer or other three dimensional printing mechanism. Fabrication of three dimensional structures using ink jet printers or similar printers that can "print" various polymer materials is well known and need not be described in further detail herein. For example, see "3D printing," Wikipedia, Sep. 4, 2014. Printing allows for the rapid and low-cost deposition of thick dielectric and metallic layers, such as 0.1 um-1000 um thick, for example, while also allowing for fine feature sizes, such as 20 um feature sizes, for example.

Figure 7:
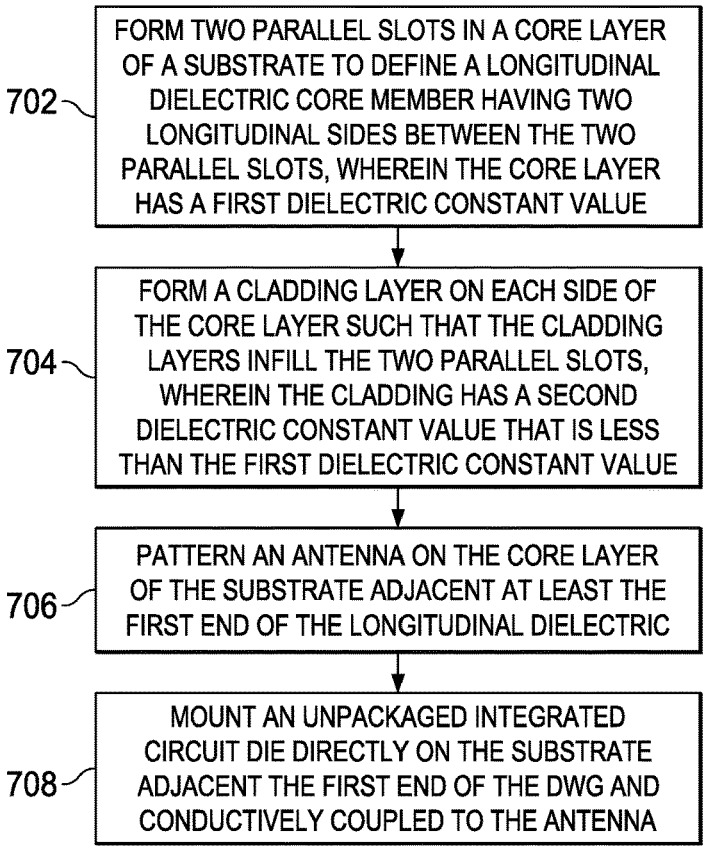
FIG. 7 is flow diagram illustrating fabrication of a dielectric waveguide integrated into a flexible substrate.

FIG. 7 is flow diagram illustrating fabrication of a dielectric waveguide integrated into a substrate. For each DWG, two parallel slots are formed at step 702 in a core layer of a substrate to define a longitudinal dielectric core member having two longitudinal sides between the two parallel slots. As discussed above in paragraph, ([0036]) in more detail, the core layer has a first dielectric constant value, such as 3.5 for polyamide. Multiple DWG may be formed parallel to each other and share intermediate slots, as illustrated in FIG. 3.

A cladding layer is formed at step 704 on each side of the core layer such that the cladding layers infill the two parallel slots. As discussed above in paragraph ([0036]) in more detail, the cladding has a second dielectric constant value that is less than the first dielectric constant value. In some embodiments, the cladding layers may extend beyond the width of the waveguide, as illustrated in FIG. 5C. In other embodiments, the cladding layers may extend only approximately a width of the waveguide, as illustrated in FIG. 5B.

The DWG has a first end and an opposite end at each end of the two longitudinal sides. A signal launching antenna may be patterned at step 706 on the core layer of the substrate adjacent at least the first end of the longitudinal dielectric core member. The signal launching antenna may include a reflector formed as an array of conductive vias, as described in more detail above.

An unpackaged integrated circuit die may be mounted at step 708 directly on the substrate adjacent the first end of the DWG and conductively coupled to the signal launching antenna. Similarly, an unpackaged integrated circuit die may be mounted at step 708 directly on the substrate adjacent an opposite end of the DWG and conductively coupled to another signal launching antenna.

In this manner, extremely low cost systems may incorporate DWG technology by forming one or more DWGs directly within a multilayer substrate. The substrate may be flexible or rigid.

Other Embodiments

While the invention has been described with reference to illustrative embodiments, this description is not intended to be construed in a limiting sense. Various other embodiments of the invention will be apparent to persons skilled in the art upon reference to this description. For example, the substrate on which a dielectric core waveguide is formed may be rigid or flexible, for example.

While waveguides with polymer dielectric cores have been described herein, other embodiments may use other materials for the dielectric core, such as ceramics, glass, paper, etc., for example.

In some embodiments, a conductive coating may be laminated or otherwise applied over the cladding on one or both sides of the substrate to provide further signal isolation to the DWG.

The processes described herein allows the cross section of a dielectric core to change along the length of a waveguide by adjusting the position of the slots in order to adjust impedance, produce transmission mode reshaping, etc., for example.

While a straight DWG is illustrated in the examples herein, in other embodiments the DWG may include one or more bends. The bend(s) may be in the form of a right angle, a chamfered corner, a smooth curve, etc., for example. As mentioned above, an occasional nib may be left spanning the slot in the region around a bend or curve to stabilize the core portion between the slots, as long as the nib is much smaller than the wavelength of the EM wave travelling through the DWG. Once the cladding layers are applied, the cladding will provide stabilization for the core between the slots.

The dielectric core of the conductive waveguide may be selected from a range of approximately 2.4-12, for example. These values are for commonly available dielectric materials. Dielectric materials having higher or lower values may be used when they become available.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A system comprising:

a multilayer substrate having at least a core layer having a first dielectric constant value, a top layer adjacent the core layer and a bottom layer opposite adjacent the core layer, wherein the top layer and the bottom layer have a dielectric constant value that is lower than the first dielectric constant value;

a dielectric waveguide (DWG) formed within the multilayer substrate, wherein the dielectric waveguide comprises:

a longitudinal dielectric core member formed in the core layer having two adjacent longitudinal sides each separated from the core layer by a corresponding slot portion formed in the core layer, such that the dielectric core member has the first dielectric constant value; and a cladding surrounding the dielectric core member formed by the top layer and the bottom layer infilling the corresponding slot portions of the core layer, wherein the cladding has a dielectric constant value that is lower than the first dielectric constant value.

2. The system of claim 1, wherein the cladding is a layer formed c on the dielectric core member and extending beyond the DWG.

3. The system of claim 1, wherein the DWG includes an antenna patterned on the multilayer substrate adjacent at an end of the longitudinal dielectric core member.

4. The system of claim 3, further comprising an unpackaged integrated circuit die mounted directly on the multilayer substrate adjacent the end of the longitudinal dielectric core member and conductively coupled to the antenna.

5. The system of claim 1, wherein the substrate is a rigid substrate.

6. A method for forming a dielectric waveguide (DWG), the method comprising:

forming two parallel slots in a core layer of a substrate to define a longitudinal dielectric core member having two longitudinal sides between the two parallel slots, wherein the core layer has a first dielectric constant value; and forming cladding layers on the dielectric core member such that the cladding layers infill the two parallel slots, wherein the cladding has a second dielectric constant value that is less than the first dielectric constant value.

7. The method of claim 6, wherein the cladding layers extend beyond the waveguide.

8. The method of claim 6, wherein the cladding layers extend approximately a width of the waveguide.

9. The method of claim 6, wherein the cladding layers are formed c by three dimensional printing onto a surface of the core layer of the substrate.

10. The method of claim 6, wherein the DWG includes an antenna c patterned on the substrate adjacent an end of the longitudinal dielectric core member.

11. The method of claim 10, further comprising forming a reflective array of conductive vias in the core layer of the substrate adjacent the antenna.

12. The method of claim 10, further comprising mounting an unpackaged integrated circuit die directly on the substrate adjacent the end of the longitudinal dielectric core member and conductively coupled to the antenna.

13. An apparatus comprising:

a dielectric waveguide (DWG) formed within a multilayer substrate, wherein the dielectric waveguide comprises:

a longitudinal dielectric core member formed in a core layer having two adjacent longitudinal sides each separated from the core layer by a corresponding slot portion formed in the longitudinal dielectric core member, such that the dielectric core member has a first dielectric constant value; and a cladding surrounding the dielectric core member formed by a top layer and a bottom layer infilling the corresponding slot portions of the core layer, wherein the cladding has a dielectric constant value that is lower than the first dielectric constant value.

14. The apparatus of claim 13, wherein the cladding is a layer formed on the dielectric core member and extending beyond the DWG.

15. The apparatus of claim 13, wherein the DWG includes an antenna patterned on the multilayer substrate adjacent an end of the longitudinal dielectric core member.

16. The apparatus of claim 15, further comprising an unpackaged integrated circuit die mounted directly on the multilayer substrate adjacent the end of the longitudinal dielectric core member and conductively coupled to the antenna.

17. The apparatus of claim 13, wherein the substrate is a rigid substrate.

* * * * *